US006505960B2

(12) United States Patent
Schubert et al.

(10) Patent No.: US 6,505,960 B2
(45) Date of Patent: Jan. 14, 2003

(54) RECESSED LIGHTING FIXTURE LOCKING ASSEMBLY

(75) Inventors: John S. Schubert, Arlington Heights, IL (US); Christopher T. Bobrowski, Chicago, IL (US); David E. Doubek, LaGrange, IL (US)

(73) Assignee: Cooper Industries, Inc., Houston, TX (US)

( * ) Notice: Subject to any disclaimer, the term of this patent is extended or adjusted under 35 U.S.C. 154(b) by 0 days.

(21) Appl. No.: 09/810,430

(22) Filed: Mar. 19, 2001

(65) Prior Publication Data

US 2002/0131271 A1 Sep. 19, 2002

(51) Int. Cl.[7] ..... F21S 8/02
(52) U.S. Cl. ..... 362/365; 362/147; 362/368
(58) Field of Search ..... 362/147, 148, 362/364–366, 368, 370, 371

(56) References Cited

U.S. PATENT DOCUMENTS

| | | | | | |
|---|---|---|---|---|---|
| 3,660,651 | A | * | 5/1972 | Miles, Jr. | 362/366 |
| 3,872,296 | A | | 3/1975 | Cohen et al. | 362/365 |
| 4,238,815 | A | | 12/1980 | Price | 362/218 |
| 4,250,540 | A | * | 2/1981 | Kristofek | 362/368 |
| 4,293,895 | A | * | 10/1981 | Kristofek | 362/147 |
| 4,520,436 | A | | 5/1985 | McNair et al. | 362/366 |
| 4,729,080 | A | | 3/1988 | Fremont et al. | 362/366 |
| 4,803,603 | A | * | 2/1989 | Carson | 362/366 |
| 4,972,339 | A | | 11/1990 | Gabrius | 362/366 |
| 5,068,772 | A | * | 11/1991 | Shapiro et al. | 362/365 |
| D326,536 | S | | 5/1992 | Gattari | D26/74 |
| 5,124,901 | A | | 6/1992 | Sojka et al. | 362/366 |
| 5,130,914 | A | | 7/1992 | Bengochea | 362/364 |
| 5,291,381 | A | | 3/1994 | Price | 362/366 |
| 5,314,148 | A | | 5/1994 | Jones | 248/27.3 |
| 5,457,617 | A | | 10/1995 | Chan et al. | 362/366 |
| 5,548,499 | A | | 8/1996 | Zadeh | 362/366 |
| 5,581,448 | A | * | 12/1996 | Harwood | 362/147 |
| 5,609,414 | A | | 3/1997 | Caluori | 362/366 |
| 5,673,997 | A | | 10/1997 | Akiyama | 362/147 |
| 5,746,507 | A | | 5/1998 | Lee | 362/365 |
| 5,823,664 | A | | 10/1998 | Demshki, Jr. et al. | 362/366 |
| 6,004,011 | A | | 12/1999 | Sieczkowski | 362/365 |
| 6,095,669 | A | | 8/2000 | Cho | 362/365 |
| 6,123,438 | A | | 9/2000 | Hentz | 362/373 |

* cited by examiner

*Primary Examiner*—Alan Cariaso
(74) *Attorney, Agent, or Firm*—Thomas, Kayden, Horstemeyer & Risley LLP

(57) ABSTRACT

A recessed lighting fixture for mounting to a ceiling includes a housing, a frame, and at least one locking assembly. The housing includes a side wall, an opening, a lip extending outwardly around at least a portion of a circumference of the opening, and a slot in the side wall. The frame has an aperture sized for slidably receiving the housing. The at least one locking assembly is configured to move between a locked position and an unlocked position and is mountable in the slot. When in the locked position, the locking assembly exerts a force to compress the ceiling between the lip and the frame.

21 Claims, 11 Drawing Sheets

FIG. 9a
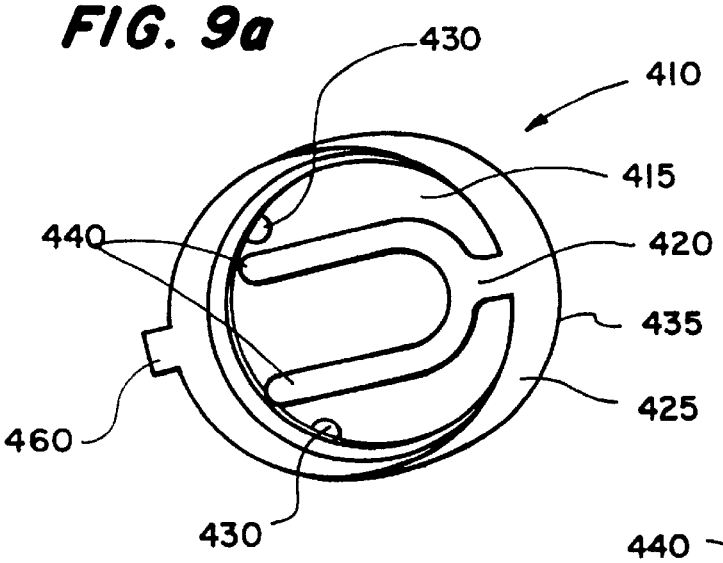
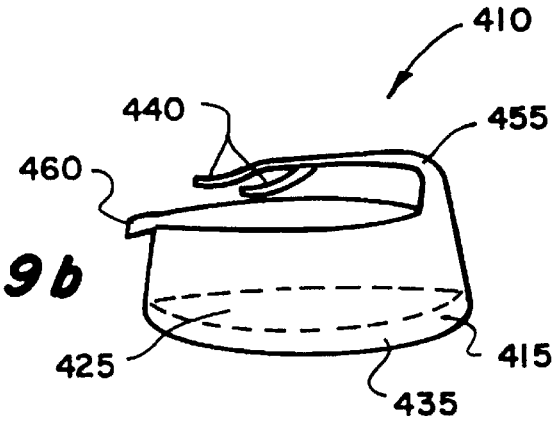
FIG. 9b
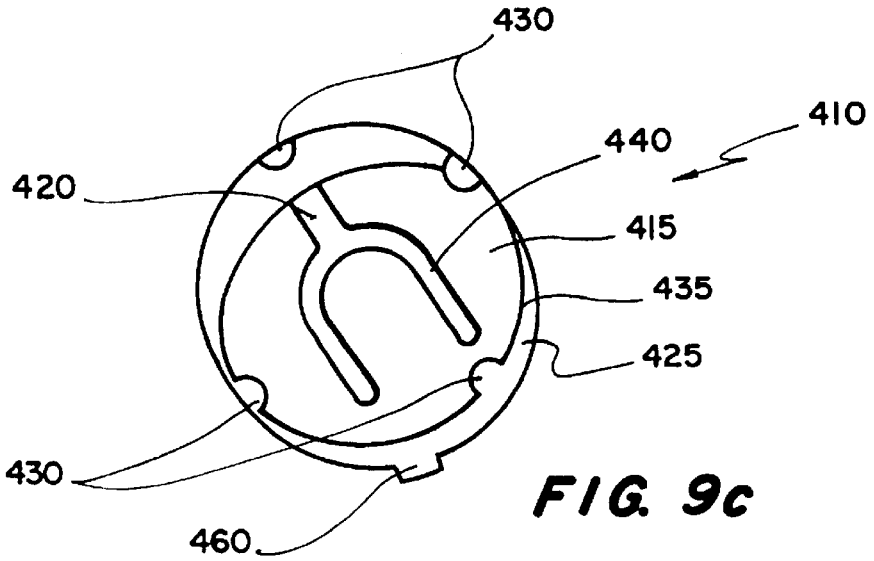
FIG. 9c

RECESSED LIGHTING FIXTURE LOCKING ASSEMBLY

TECHNICAL FIELD

This invention relates to recessed lighting fixtures having locking assemblies.

BACKGROUND

Recessed lighting fixtures typically are mounted in the space above the ceiling of a room with the light projecting from the ceiling to illuminate the room below. To cover the hole and provide an attractive decorative finish, a trim ring usually is mounted to the fixture or the fixture's housing and pulled flush to the lower surface of the ceiling. The lighting fixture frame can be placed in the space above the ceiling either before or after the ceiling is installed. If the lighting fixture is installed before the ceiling is installed, the frame may be, for example, nailed to the ceiling joists with little difficulty. The housing then may be attached to the frame, and the trim ring may be attached to the housing or frame. If the fixture is placed in the ceiling space after the ceiling is installed, the installer must cut a hole in the ceiling material and mount the frame to the joists or the ceiling material. Once the frame is mounted, the housing can be attached to the frame, for example, using spring clips. The trim ring then is mounted to the housing or frame.

SUMMARY

In one general aspect, a recessed lighting fixture for mounting to a ceiling includes a housing, a frame, and at least one locking assembly. The housing includes a side wall, an opening, a lip extending outwardly around at least a portion of a circumference of the opening, and a slot in the side wall. The frame has an aperture sized for slidably receiving the housing. The at least one locking assembly is configured to move between a locked position and an unlocked position and is mountable in the slot. When in the locked position, the locking assembly exerts a force to compress the ceiling between the lip and the frame.

In other implementations, the recessed lighting fixture may include one or more of the following features. For example, the locking assembly may further include a handle and a spring lever. The handle is movable between the locked position and the unlocked position, and the spring lever includes a first portion that is connected to a second portion at a first angle such that moving the handle to the locked position forces the second portion of the spring lever against the frame in a downward direction.

The spring lever may further include a third portion connected to the second portion at a second angle such that moving the handle to the locked position forces the third portion of the spring lever against the frame in a lateral direction. The locking assembly may be configured to be movable along a length of the slot.

The handle may have a first end and a second end that includes at least one cam-shaped lobe that exerts a force against the side wall when the locking assembly is in the locked position. The second end may further include a generally flat region that is adjacent to the cam-shaped lobe and the locking assembly may be slidable within the slot when the handle is in the unlocked position.

The locking assembly may further include a retaining clip and a hinge pin that passes through the retaining clip, the spring lever, and the handle. The retaining clip may be configured to be positioned against an outside surface of the side wall and the handle may be configured to be positioned against an inside surface of the side wall. The retaining clip may include compressible legs that are compressed against an outside surface of the side wall when the handle is positioned against an inside surface of the side wall.

The recessed lighting fixture may further include a second locking assembly and a second slot in the side wall. The slot may extend through the lip. The lip may extend around the entire circumference of the opening. An adjustable lamp assembly may be mounted within the housing and configured to adjust a rotational position of the lamp assembly and a directional position of the lamp assembly.

In another general aspect, a recessed lighting fixture may be mounted in a ceiling. The recessed lighting fixture may include a housing, a frame and at least one locking assembly. The housing includes a side wall, an opening, a lip extending outwardly around at least a portion of a circumference of the opening, and a slot in the side wall. The frame includes an aperture sized for slidably receiving the housing. The locking assembly is configured to move between a locked position and an unlocked position and is mountable in the slot to exert a force to compress the ceiling between the lip and the frame when in the locked position. Mounting the fixture in the ceiling includes positioning the frame in the ceiling, sliding the housing into the frame, and moving the locking assembly to the locked position to exert a force to compress the ceiling between the lip and the frame.

In other implementations, mounting the recessed lighting fixture in the ceiling may include one or more of the following features. For example, positioning the frame in the ceiling may further include passing the frame through a hole in the ceiling and positioning the aperture above the hole in the ceiling. Mounting the fixture in the ceiling also may include adjusting the position of the lip of the housing relative to a lower surface of the ceiling to compensate for a thickness of the ceiling. The locking assembly may be slidable within the slot and adjusting the position of the lip may further include slidably adjusting a position of the locking assembly in the slot.

The locking assembly may further include a handle and a spring lever. The handle is movable between the locked position and the unlocked position. The spring lever includes a first portion connected to a second portion at a first angle such that moving the locking assembly to the locked position comprises rotating the handle to force the second portion of the spring lever against the frame in a downward direction. The handle may have a first end and a second end, the second end may include at least one cam-shaped lobe, and moving the handle to the locked position causes the cam-shaped lobe to exert a force against the side wall. The second end may further include a generally flat region adjacent to the cam-shaped lobe and moving the handle to the unlocked position causes the locking assembly to be slidable within the slot.

In further implementations, the recessed lighting fixture mounted in the ceiling may include any of the features described above.

Recessed lighting fixtures use, for example, spring clips to secure the fixture housing or frame. In addition, the spring clips rely on the ceiling material for support. The force of the spring clips increases as the ceiling thickness increases, which can cause some ceiling materials to break or fracture under some circumstances. Moreover, the spring clips also can be difficult to remove for inspection or adjustment of the fixture. Typically, installation requires tools in order to secure the fixture.

The recessed lighting fixture with locking assembly can be installed through a ceiling opening and provides a simplified, tool-free method of retaining or adjusting the fixture housing. The fixture's locking assembly, housing lip, and frame maintain a constant pressure on the ceiling around the circumference of the opening through a range of ceiling thicknesses. The cam action of the locking assembly increases pressure on the ceiling as the assembly is locked into place, which securely retains the lighting fixture to the ceiling. The locking assembly can be conveniently operated from inside the fixture housing to cause the spring lever to apply pressure onto the fixture frame. This feature distributes the retaining forces around the circumference of the opening to provide a constant and uniform retention force, which minimizes the potential for damage to the ceiling.

The details of one or more implementations of the recessed lighting fixture are set forth in the accompanying drawings and the description below. Other features and advantages of the recessed light fixture will be apparent from the description, the drawings, and the claims.

DESCRIPTION OF DRAWINGS

FIGS. 9*a*–9*c* are top, side, and bottom views of a lamp assembly for the recessed lighting fixture of FIG. 1.

Like reference symbols in the various drawings indicate like elements.

DETAILED DESCRIPTION

Figure 1:
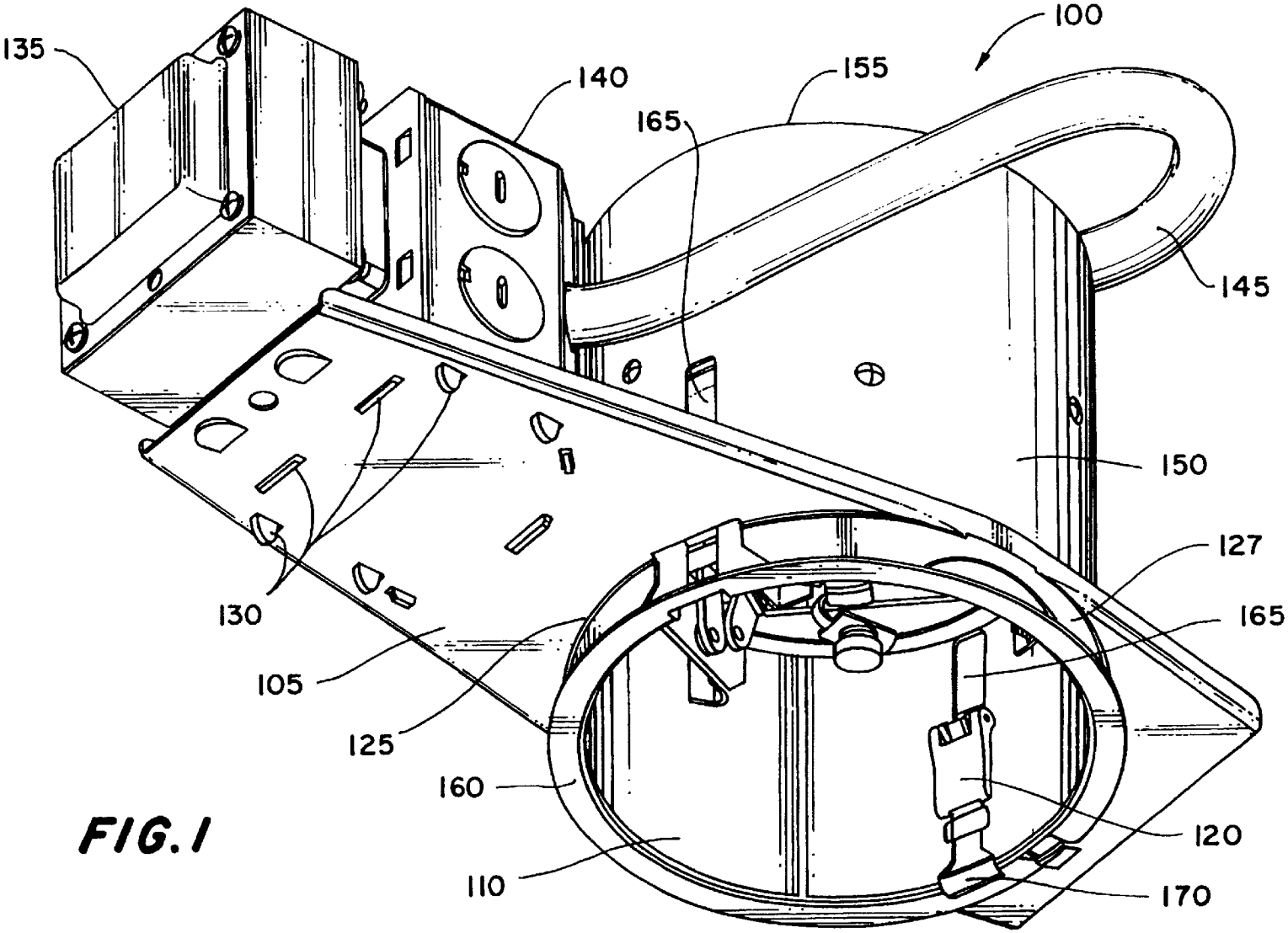
FIG. 1 is a perspective bottom view of a recessed lighting fixture with a locking assembly.
Figure 2:
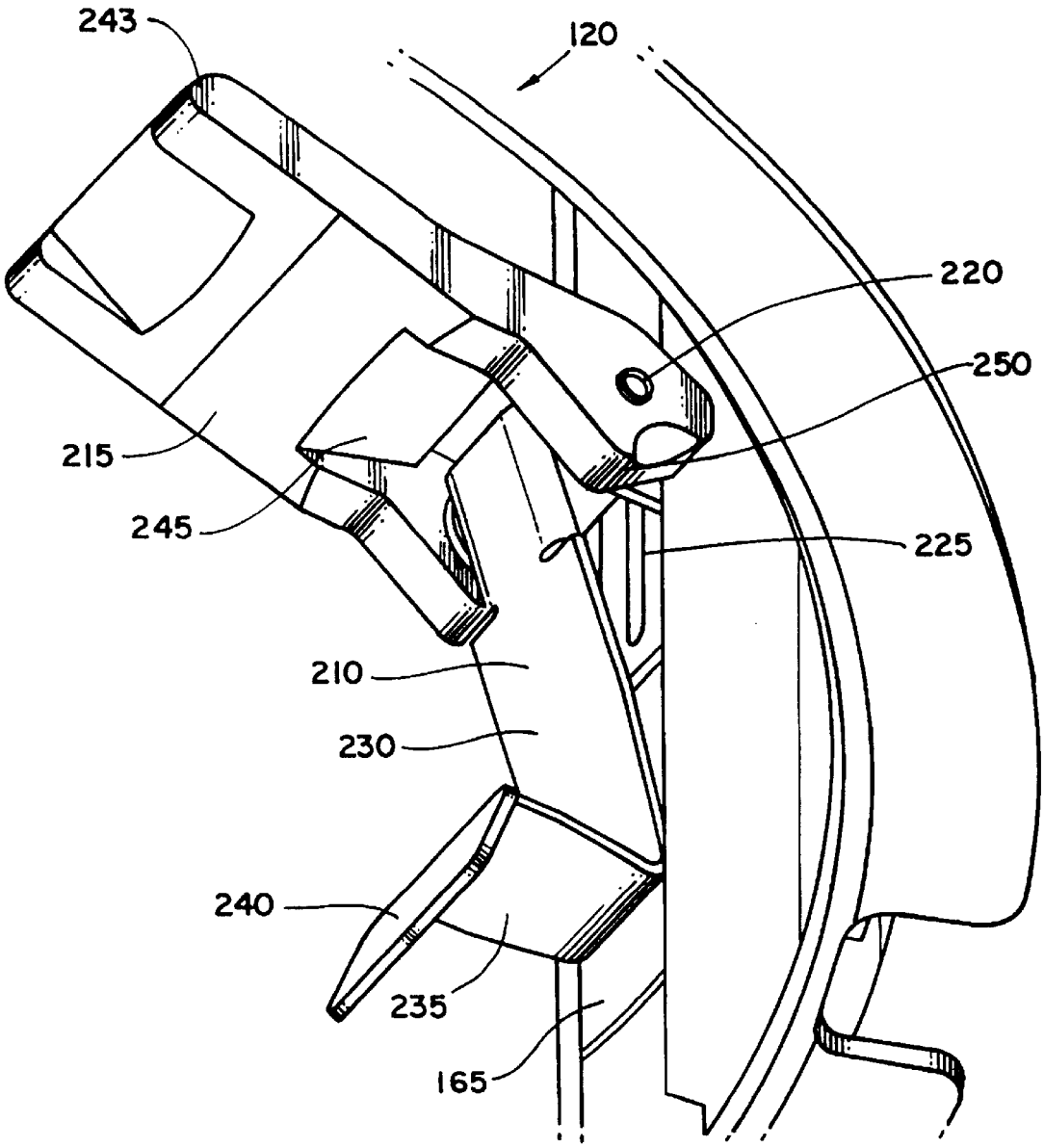
FIGS. 2–4 are perspective and side views of the locking assemblies of FIG. 1.

Referring to FIG. 1, a recessed light fixture 100 is configured to be positioned within a ceiling space to illuminate a room. The fixture 100 includes a frame 105, a housing 110, and a locking assembly 120 that is used to fix the position of the housing relative to the frame with a ceiling of any thickness being positioned therebetween. Generally, the frame 105 is a flat plate that rests on top of an upper surface of the ceiling. The frame 105 includes a circular aperture 125 that is sized to receive the housing 110 and includes a downwardly directed lip 127 that encloses the aperture 125. The frame 105 also includes slits 130 for mounting a transformer 135 and/or a junction box 140 to the frame. Additionally, the fixture 100 has a shielded cable 145 running from the junction box 140 and extending through a hole (not shown) in the housing 110. The cable 145 encloses electrical wires that power a lamp inserted in a socket in the housing 110.

The housing 110 has a cylindrical sidewall 150 and a flat upper surface 155. The bottom of the housing 110 is open for receiving a light socket and lamp, and for projecting illumination to a room below the ceiling. The housing 110 has a flared lip 160 around the outer-circumference of the sidewall 150. The housing 110 also has one or more elongated slots 165 extending from the bottom to about mid-way up the sidewall 150 for use with the locking assembly 120. The slots 165 may have a wider opening 170 near the bottom of the sidewall 150 and extending into the lip 160.

Although the housing is illustrated as being cylindrical, the housing 110 can be of any shape that mates with or passes through the aperture 125. For example, the housing 110 and the aperture 125 can be of an oval shape with the length of the oval shape being in the direction of the length of the frame. In this manner, the frame does not need to be as wide but still can provide an aperture of the same cross-sectional area to deliver as much illumination.

Referring also to FIGS. 2–6, the locking assembly 120 includes a spring lever 210 and a rotateable handle 215. The spring lever 210 and the handle 215 are connected by a hinge pin 220 to a retaining clip 225. The retaining clip 225 includes a pair of projections 226 through which the hinge pin 220 passes, legs 227, and a strengthening ridge 228 to add rigidity to the clip. The spring lever 210 includes a main portion 230, a leg 235 that is bent at an angle from the main portion 230, and a foot 240 that is bent at an angle from the leg 235 and is substantially wider than the main portion 230 and the leg 235. The handle 215 includes a first end 243, a recessed region 245, and a second end 250. The second end 250 has a cam-shaped lobe and includes three distinct regions: a first cam region 255, a second cam region 260, and a flat region 265 positioned between the cam regions 255 and 260. The hinge pin 220 passes through the second end 250. The handle 215 contacts the spring lever 210 at a recessed region 245 of the handle 215 when the second cam region 260 is pressed against the main portion 230.

The locking assembly 120 is positioned in the elongated slots 165 of the sidewall in the housing 100 with the retaining clip 225 outside the housing 110 and the spring lever 210 and the handle 215 inside the housing. This is accomplished by sliding the locking assembly 120 through the opening 170 at a point near the hinge 220 such that the retaining clip is on the outside of the sidewall 150 and the spring lever 210 and the handle 215 are on the inside of the side wall. When the flat region 265 is adjacent to the side wall 150, the locking assembly 120 can be moved freely within the slots 165. When the handle 215 is rotated such that the first cam region 255 or the second cam region 260 is pressed against the side wall 150, the retaining clip legs 227 are compressed down onto the wall 150, which clamps the locking assembly 120 in place.

Figure 7:
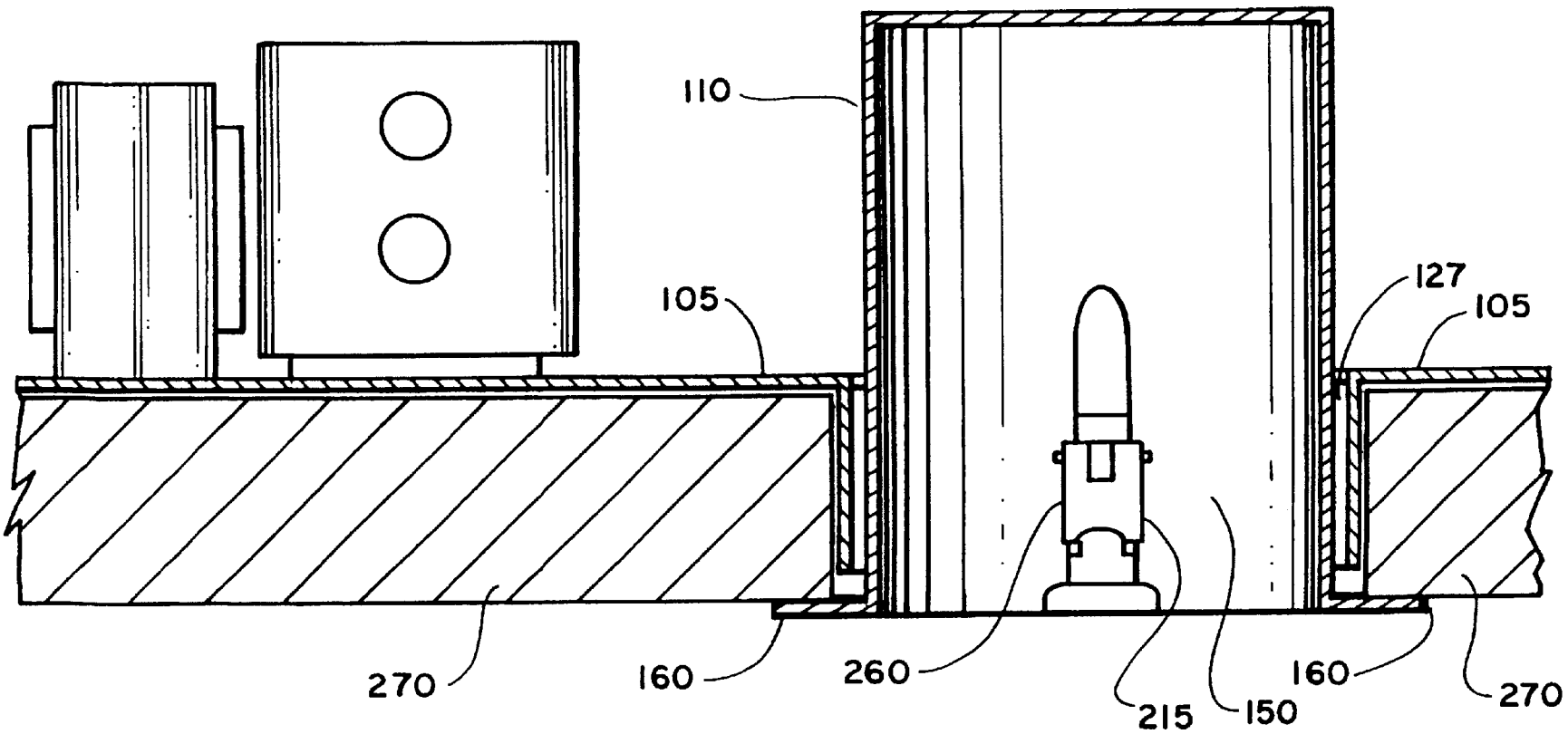
FIG. 7 is a cross-sectional side view of the recessed lighting fixture of FIG. 1 mounted to a ceiling.

Thus, the locking assembly can slide along the entire length of the elongated slot to permit a ceiling of any thickness to be positioned between the frame 105 and the flared lip 160 of the housing. For example, as illustrated in FIG. 7, a ceiling 270 is positioned between the frame 105 and the flared lip 160. When the handle 215 is positioned such that the second cam region 260 is pressed against the side wall 150, the foot 240 presses down against the frame 105, which pulls the housing 110 up towards the frame. In this manner, the entirety of the flared lip 160 is pressed up against the lower surface of the ceiling and the frame 105 is pulled down against the upper surface of the ceiling such that both surfaces of the ceiling are compressed between the lip and the frame. This prevents isolated areas of stress on the ceiling; which can damage the ceiling if the locking mechanism clamps down too hard on the ceiling. For example, a ceiling made of sheet rock may crumble in the regions of higher or isolated stress applied to the ceiling.

FIG. 1 shows two locking assemblies 120, each of which includes a spring lever 210 and a handle 215, and is positioned in a separate set of slots 165. The locking assemblies 120 are positioned on opposing sides of the cylindrical sidewall 150. In other implementations, however, the recessed lighting fixture 100 may have only one spring lever 210, handle 215, and slot 165, or may have more than two sets of spring levers 210, handles 215, and slots 165. Moreover, the locking assemblies may be installed in other positions on the sidewall 150 or lip 160. Alternatively, the locking assemblies 120 may be positioned on the frame 105.

Figure 3:
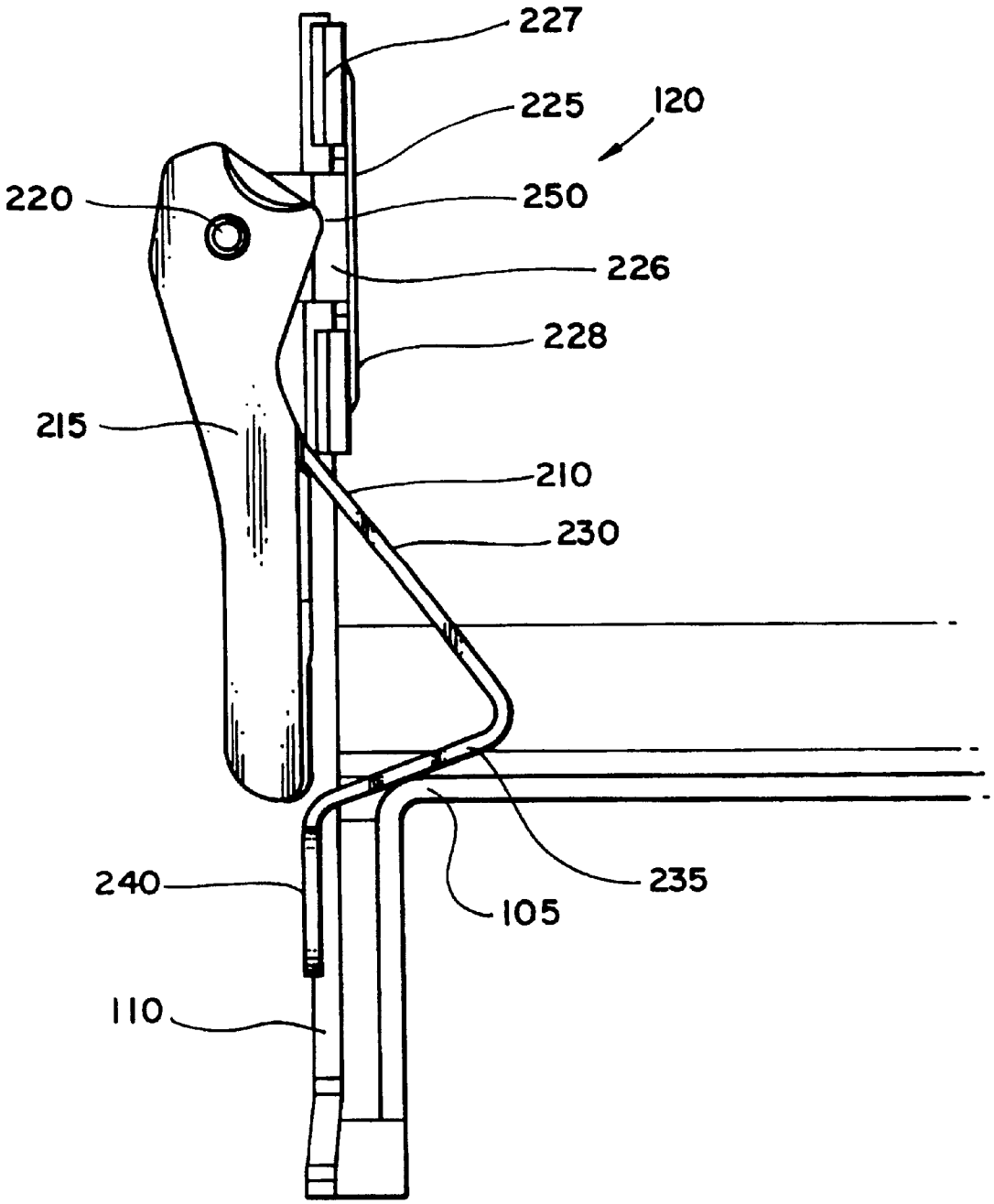
Figure 4:
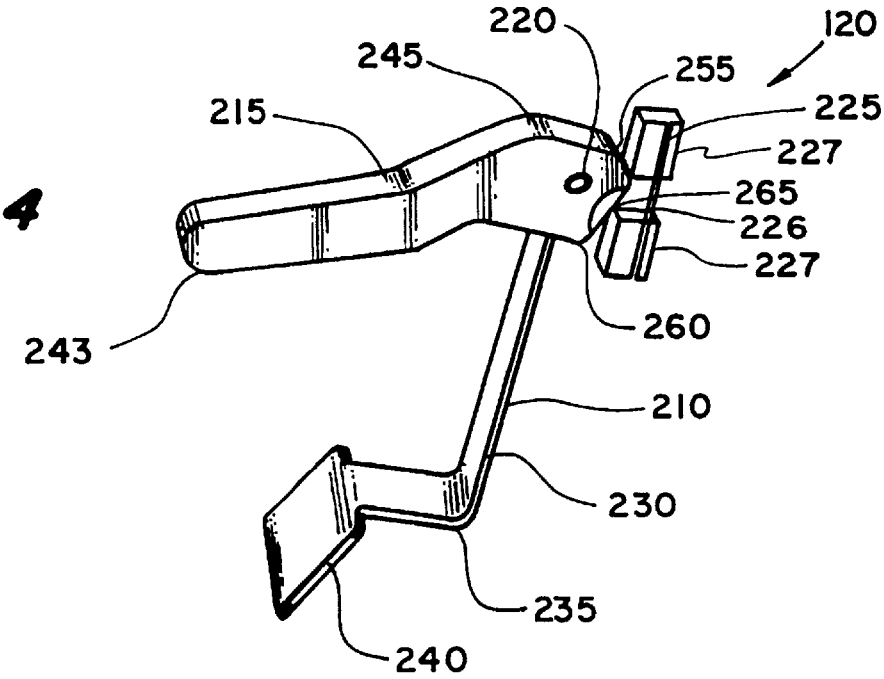
Figure 5:
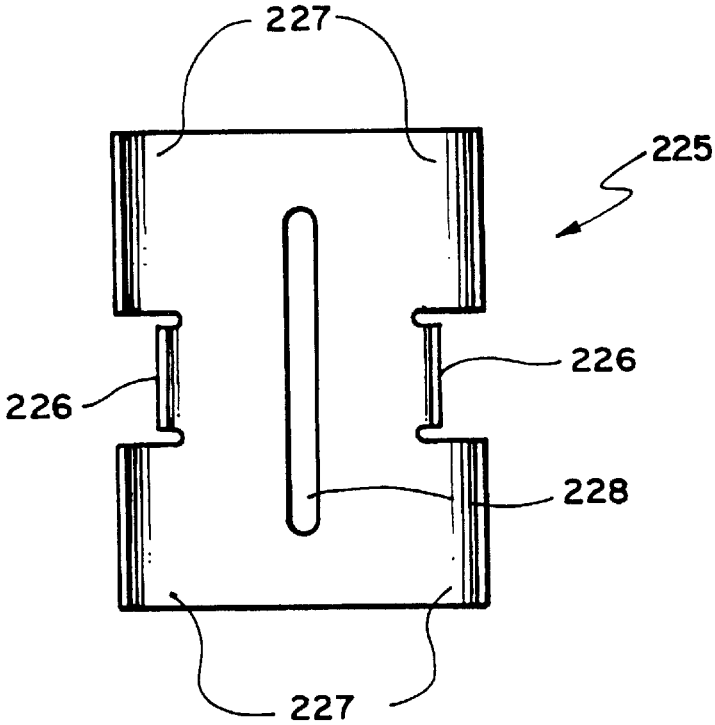
FIGS. 5 and 6 are bottom and end views, respectively, of a retaining clip of the locking assembly of FIG. 1.
Figure 6:
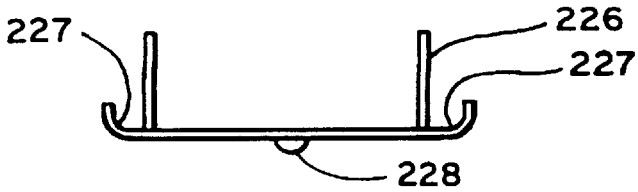

FIGS. 1 and 3 illustrate the locking assembly 120 in the locked position, in which the cam 250 prevents the handle 215 from moving to an unlocked position. In the locked position, the spring lever 210 may extend through the slot 165. However, the foot 240 may be wider than the slot 165 to allow only the main portion 230 and the leg 235 to extend through the slot 165. In the locked position, a portion of the leg 235 pushes against the frame 105 to secure the housing 110 in the frame 105.

Figure 8:
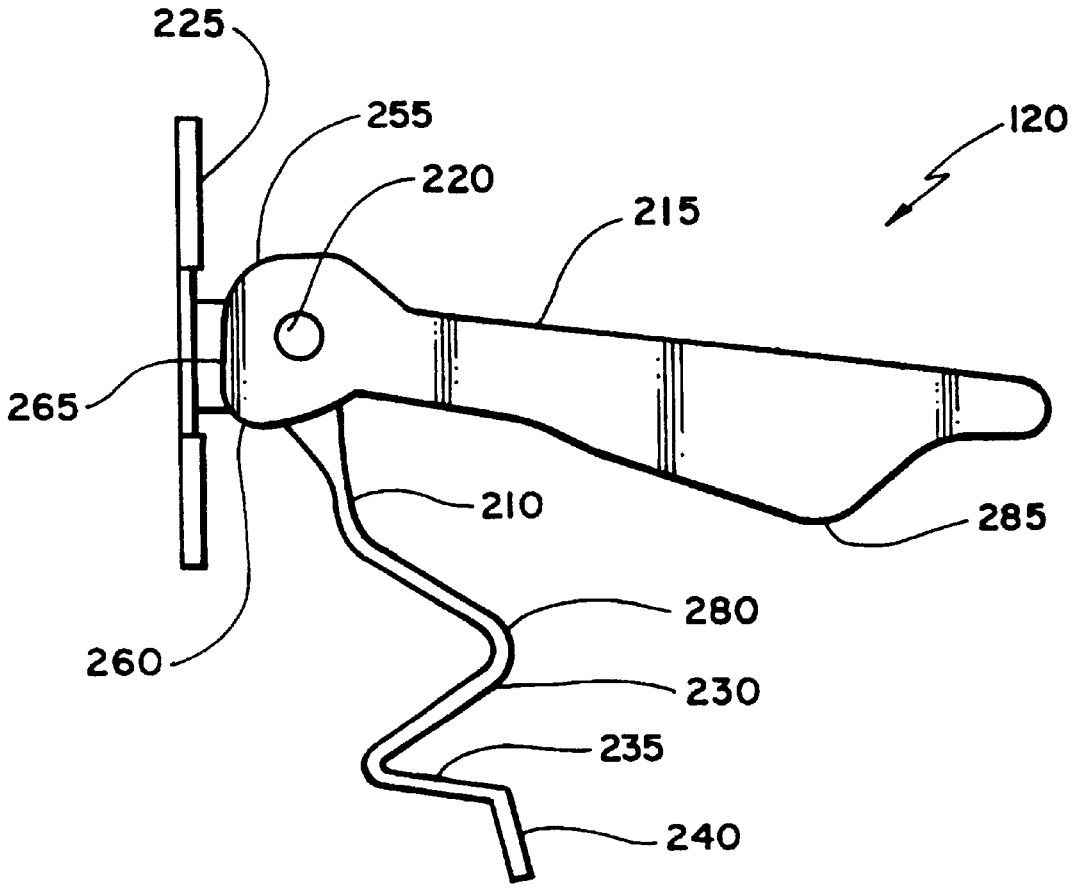
FIG. 8 is a side view of a locking assembly for use with the recessed lighting fixture of FIG. 1.

Referring to FIG. 8, the locking mechanism can be configured to exert two levels of pressure on the frame depending upon whether the first cam end 255 or the second cam end 260 is pressed against the side wall 150. To accomplish this, the locking mechanism 120 is modified by lengthening and adding a curve 280 to the main portion 230 of the spring lever 210 and adding a protrusion 285 to the handle 215. The curve 280 and the protrusion 285 are positioned such that the protrusion is forced against the curve 280 when the second cam region 260 is pressed against the side wall. In use, the leg 235 is pressed against the frame 105. The protrusion 285 forces the curve 280 into a generally straight configuration, which exerts additional pressure upon the leg 235 and the frame 105. Consequently, the ceiling 270 is positioned more firmly between the frame 105 and the flared lip 160.

Referring to FIGS. 9*a*–11, a lamp assembly may be adjustably positioned inside the housing 110 by using an angle adjustment assembly 403 and a rotation assembly 406. Referring to FIGS. 9*a–c*, the lamp assembly includes a lens holder 410, a lens 415, and an extension arm 420. The lens holder 410 has a cylindrical side 425. Typically, the lens 415 has a circular shape and is transparent or translucent. Tabs 430 on the bottom rim 435 of the lens holder 410 hold the lens 415 inside the lens holder 410.

The extension arm 420 is attached to the side 425 of the lens holder 410. For example, the extension arm 420 may be riveted or welded to the side 425, or may be integrally formed with the side. The extension arm 420 forms a right angle such that two prongs 440 extend behind an installed light bulb (not shown) to retain the bulb. A bowed ridge on the extension arm 420 and an insert tab 460 on the side 425 secure the lamp. assembly 400 to the angle adjustment assembly 403.

Figure 10:
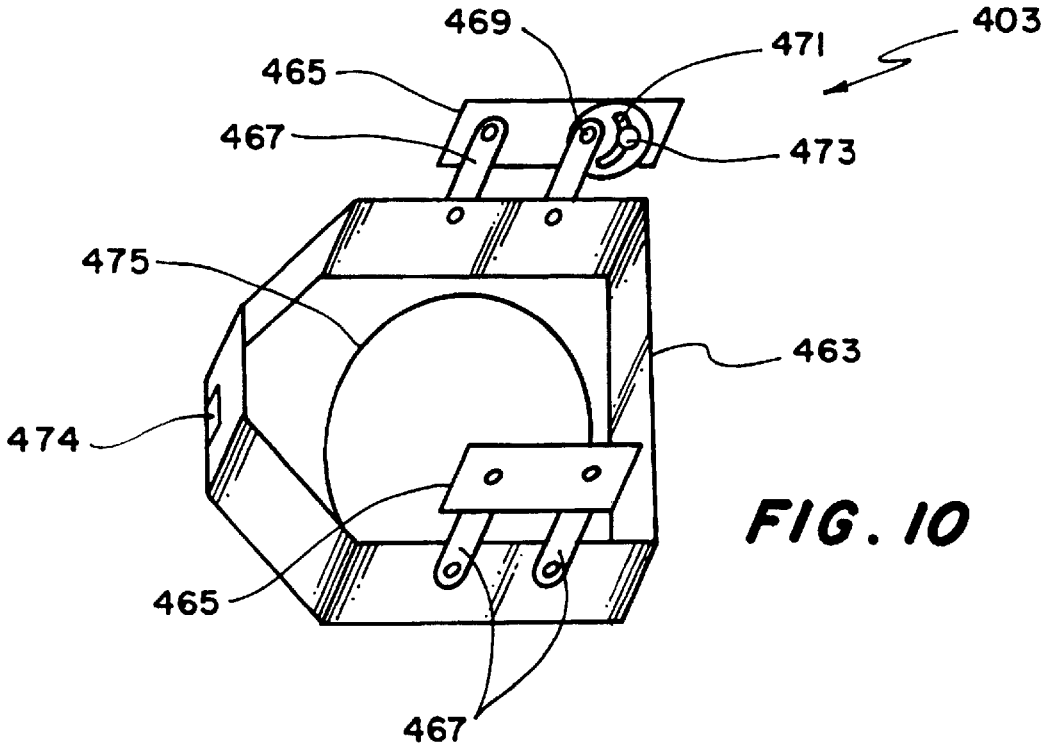
FIG. 10 is a bottom view of an angle adjustment assembly for the lamp assembly of FIGS. 9*a*–9*c*.

Referring to FIG. 10, the angle adjustment assembly 403 includes a lamp compartment 463, mounting brackets 465, mounting legs 467, an angle adjustment leg 469, an angle adjustment channel 471, and an angle adjustment screw 473. The lamp compartment 463 has sides and a bottom. The top of the lamp compartment 463 has an insert notch 474 that accepts the insert tab to secure the lamp assembly to the angle adjustment assembly 403. The bottom of the lamp compartment 463 includes a circular light aperture 475 that is sized slightly smaller than the diameter of the side 425 of the lens holder 410.

The lamp compartment 463 is hingedly connected to the mounting legs 467 and the angle adjustment leg 473. In turn, the mounting legs 474 and the angle adjustment leg 473 are hingedly connected to the mounting brackets 465. The angle adjustment screw 473 is fitted through the angle adjustment channel to the mounting bracket 465 to fix the angle of the angle adjustment leg 469 relative to the mounting bracket 465, thus also fixing the angle of the lamp compartment 463 in a particular position relative to the housing 110.

Figure 11:
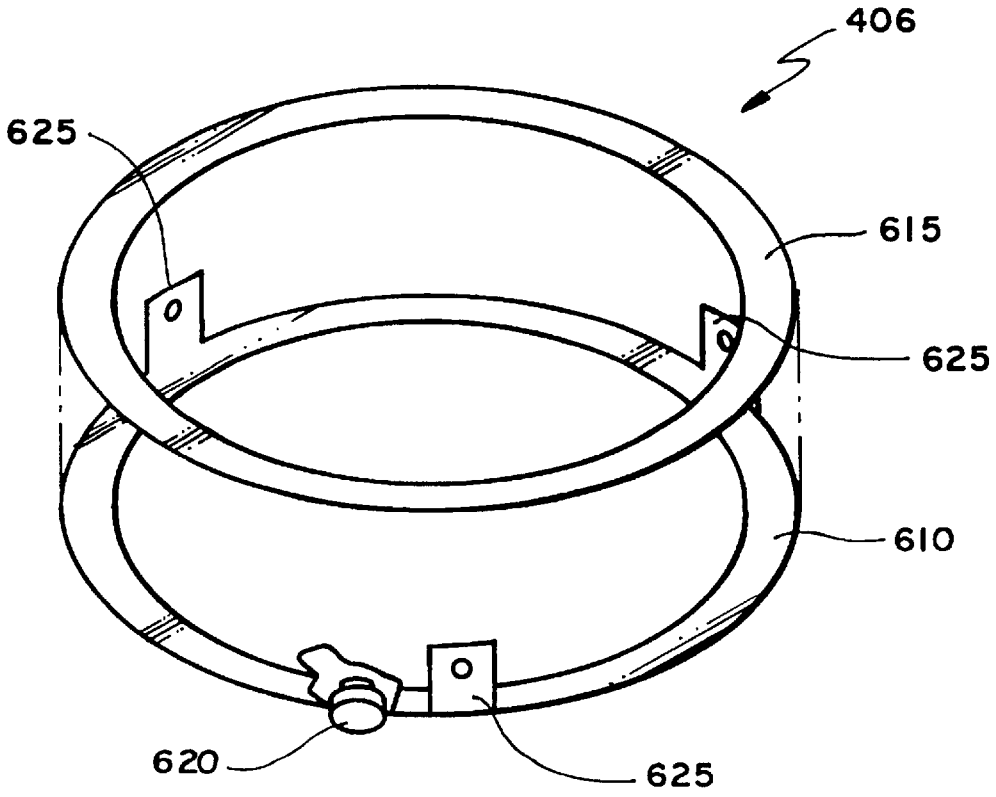
FIG. 11 is a perspective side view of a rotation assembly of the recessed lighting fixture of FIG. 1.

Referring to FIG. 11, the rotation assembly 406, which attaches to the angle adjustment assembly 403, includes a lamp ring 610, a rotation ring 615, and a rotation screw 620. The lamp ring 610 may be a circular disk mounted to the housing 110 at the top of the slots 165, at approximately midway up the sidewall 150. The lamp ring 610 may be attached, for example, by mounting arms 625 that extend from the lamp ring 610 and are riveted to the sidewall 150.

The rotation ring 615 may be a circular disk of approximately the same size as the lamp ring 610. The rotation screw 620 clamps the rotation ring 615 to the lamp ring 610 in a particular rotational orientation. The rotation ring 615 may be attached to the mounting brackets 465. For example, in one implementation, the rotation ring 615 is riveted to the mounting brackets 465. In another implementation, the rotation ring 615 and the mounting brackets 465 are formed as a single component.

Figure 12:
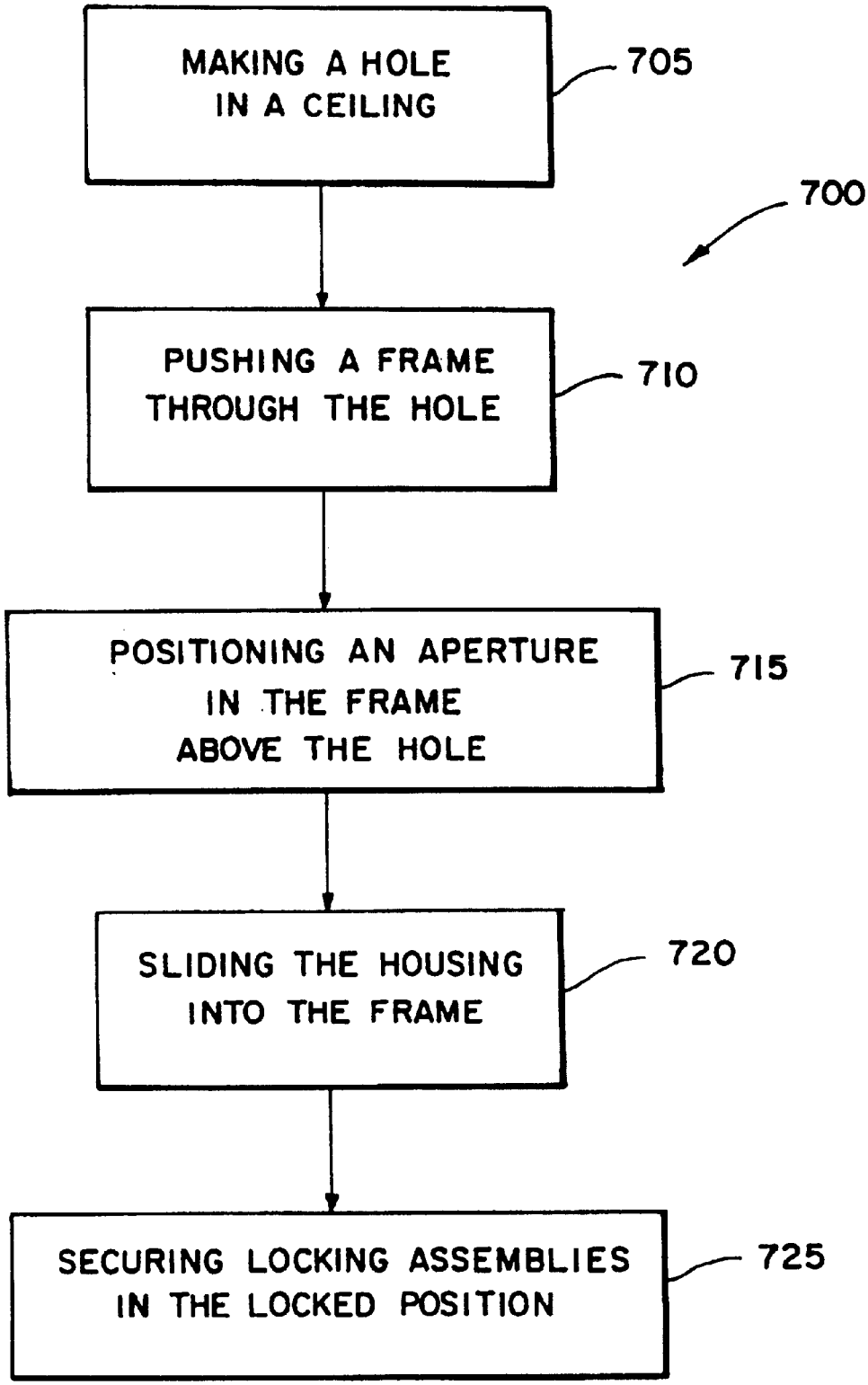
FIG. 12 is a flow chart of a method of installing the recessed lighting fixture of FIG. 1.

Referring to FIG. 12, the recessed lighting fixture 100 may be installed in a ceiling according to a method 700. Initially, an appropriately-sized hole is made in a ceiling (step 705). Next, the frame is pushed through the hole in the ceiling (step 710), and is positioned so that the frame's aperture is above the hole in the ceiling (step 715). The housing then is slid up into the frame until the housing's flared lip contacts the lower surface of the ceiling (step 720). Finally, the locking assemblies are secured in the locked position to secure the frame and housing to the ceiling (step 725). Making the hole in the ceiling (step 705) may include using manual or power tools to cut a circular hole in the ceiling. The diameter of the hole should be greater than the diameter of the aperture 125 in the frame, but less than the outside diameter of the lip 160 on the housing 110. Typically, a trim ring is used with the light fixture to cover any imperfections that may be formed when the hole is cut.

Pushing the frame through the hole in the ceiling (step 710) may include removing the housing from the frame and fitting the frame through the hole while grasping an end of the frame, such as, for example, an end near the transformer 135 or the junction box 140. This allows the frame to fit through the hole at its narrowest region around the aperture. If the frame is widest at a location adjacent to the aperture, the installer can cut two small notches in the hole in the ceiling and push the frame up through those notches. In this manner, the entire diameter of the hole does not need to be as large as the widest portion of the frame.

Positioning the aperture above the hole in the ceiling (step 715) includes lining up the aperture 125 in the frame 105 above the circular hole. Typically, the rim of the aperture 125 will slide into the hole. In this position, the installer may commence wiring the junction box 140 on the recessed lighting fixture 100 to an external electrical circuit. Of course, the installer also may wire the junction box before passing the fixture through the opening.

Sliding the housing into the frame (step 720) typically is performed after the external wiring is connected to the fixture. The housing 10 is installed in the frame 105 by sliding the housing 110 up through the aperture 125. Next, the housing is raised or lowered to its desired position, depending upon the ceiling thickness and the amount of force desired to be imparted by the fixture 100 upon the ceiling. Typically, the housing will be pushed up until the lip 160 rests against the lower surface of the ceiling.

Securing the locking assemblies in the locked position (step 725) is performed by rotating the handle 215 downward to contact the spring lever 210. The spring lever 210 is pushed through the slot 165 by the handle 215 causing the leg 235 of the spring lever 210 to contact and apply pressure to the frame 105. Such pressure provides an upward force on the housing 110, which cause the lip 160 to fit snugly against the bottom surface of the ceiling as the handle 215 is rotated downward to a vertical position against the sidewall 150 of the housing 110.

After the housing 110 is secured, a light bulb may be installed in the lamp assembly. Next, the lamp assembly may be attached to the lamp compartment by inserting the insert tab 460 into the insert notch 474.

Once the installation of the recessed light fixture 100 is complete, the direction of the light beam from the recessed light fixture 100 may be adjusted. Adjusting the rotational orientation of the light beam includes loosening the rotation screw 620, rotating the rotation ring 615 to the desired position, and retightening the rotation screw. The angle of rotation may be up to one complete revolution, or 360 degrees.

Adjusting the angle of the light beam includes loosening the angle adjustment screw 473, moving the lamp assembly and light bulb to the desired angle, and retightening the angle adjustment screw. The angle of the light beam may be adjusted from a vertical direction (straight down) to approximately 30 degrees from the downward position relative to the sidewall 150.

Figure 13:
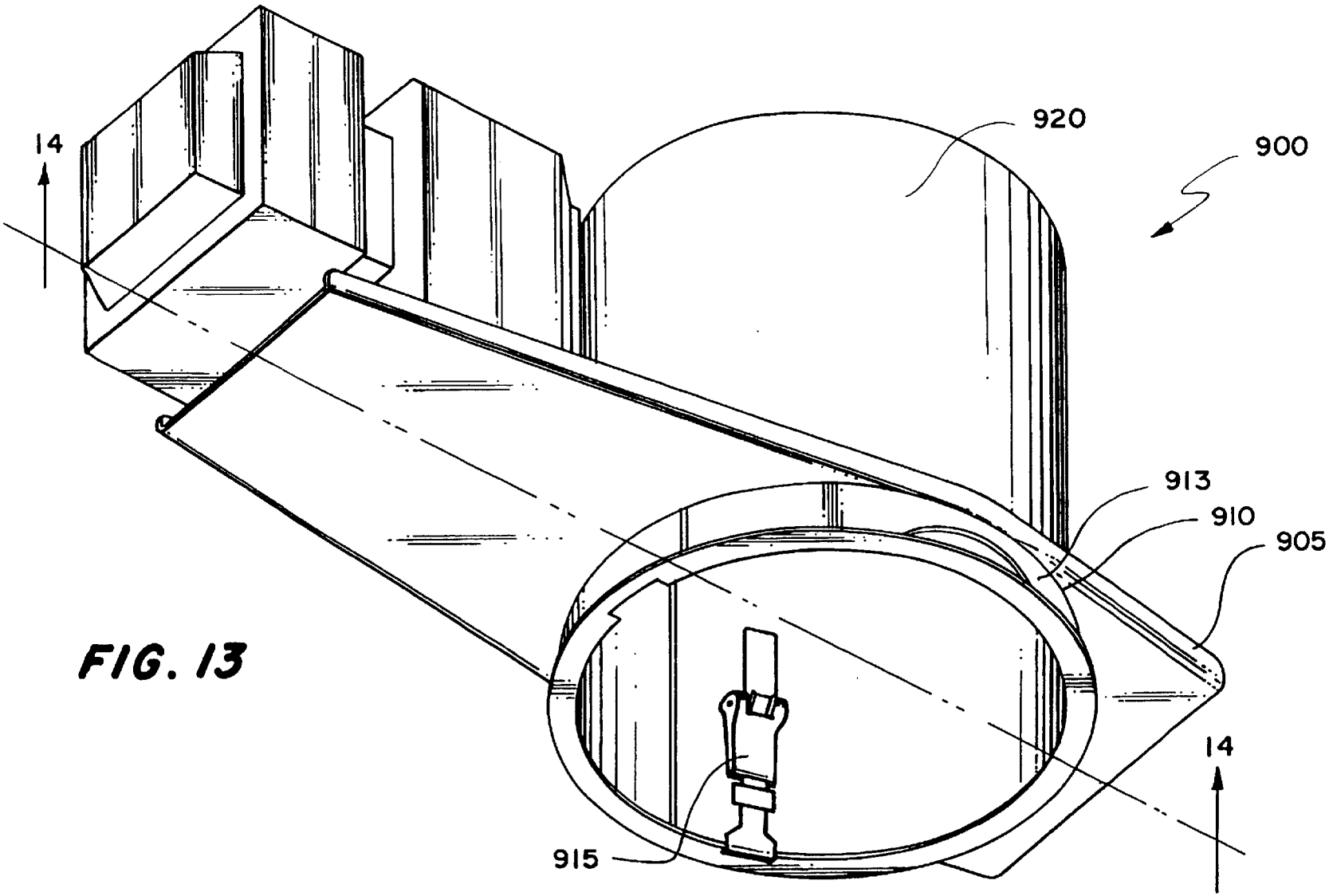
FIG. 13 is a perspective side view of a recessed lighting fixture having an aperture and housing with an oval cross-section.
Figure 14:
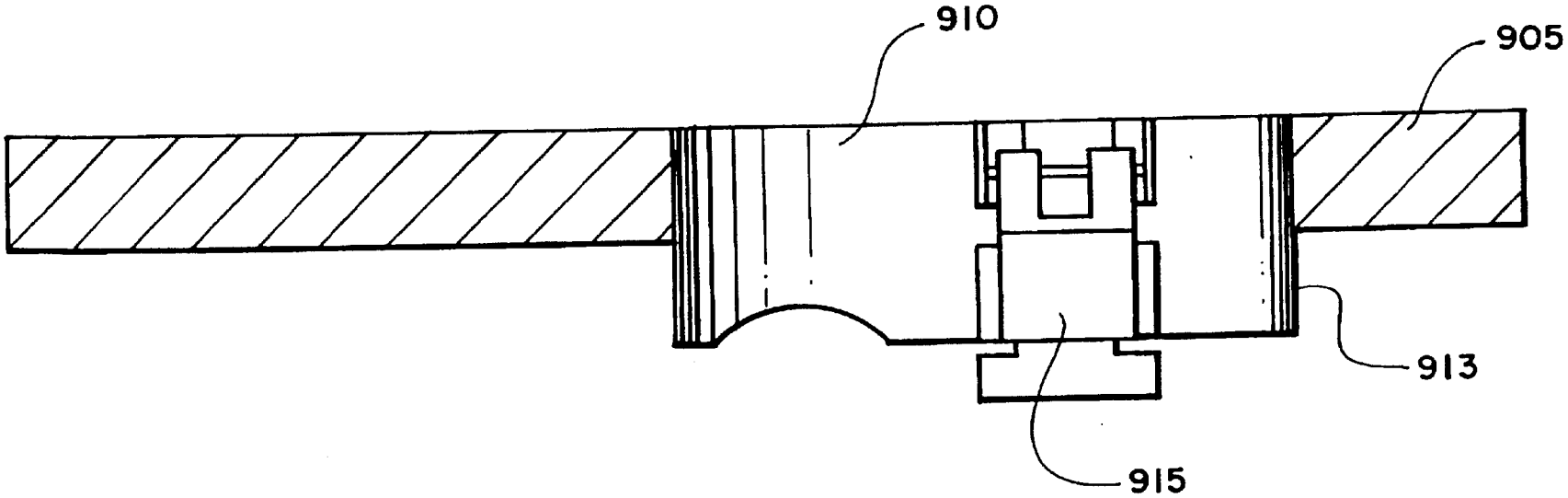
FIG. 14 is a cross-sectional side view of the frame of FIG. 13 taken along section lines 14—14.

Other implementations are within the scope of the following claims. For example, although the housing 110 and the aperture 125 through the frame are illustrated as having cylindrical cross-sections, the housing and the aperture can have any mating cross-sectional shapes. Similarly, although the locking mechanisms 120 are shown as being loose and removable from the housing and frame, they can be mounted to either the housing 110 or the frame 105. Referring to FIGS. 13 and 14, a recessed lighting fixture 900 includes a frame 905 that has an aperture 910 with an oval cross-section, a downwardly directed lip 913, and a single locking mechanism 915, which is mounted to the lip. A housing 920 that is insertable into the aperture 910 also has an oval cross-section that mates with the cross-section of the aperture 910. An oval cross-section of the frame 905 and housing 920 can be used to narrow the frame while also maintaining the same cross-sectional area of the opening of the housing. If the length of the oval is collinear with the length of the frame, the width of the frame can be minimized and, consequently, a smaller opening can be made in the ceiling when mounting the recessed lighting fixture 900.

What is claimed is:

1. A recessed lighting fixture for mounting to a ceiling, comprising:

a housing having a side wall, an opening, a lip extending outwardly around at least a portion of a circumference of the opening, and a slot in the wall;

a frame having an aperture sized for slidably receiving the housing;

a retaining clip slideable along the slot;

a handle, rotatably secured to the retaining clip, for locking the retaining clip in the slot;

a spring lever, extending from the retaining clip, for urging the housing into engagement with the frame when the retaining clip is locked by the handle in the slot.

2. The recessed lighting fixture of claim 1, wherein an end of the handle has at least one cam-shaped lobe for exerting a force against the side of the wall when the handle is rotated into a locked position.

3. The recessed lighting fixture of claim 2 wherein the end of the handle further includes a generally flat region adjacent to the cam-shaped lobe for positioning adjacent to the slot when the handle is in an unlocked position.

4. The recessed lighting fixture of claim 1 wherein the retaining clip is configured to be compressed against an outside surface of the side wall when the handle is positioned against an inside surface of the side wall.

5. The recessed lighting fixture of claim 1 wherein the retaining clip Includes compressible legs configured to be compressed against an outside surface of the side wall when the handle is positioned against an inside surface of the side wall.

6. The recessed lighting fixture of claim 1 wherein the slot extends through the lip.

7. The recessed lighting fixture of claim 1 wherein the lip extends around the entire circumference of the opening.

8. The recessed lighting fixture of claim 1 further comprising an adjustable lamp assembly mounted within the housing for adjusting a rotational position of the lamp assembly and a directional position of the lamp assembly.

9. The recessed lighting fixture recited in claim 1 wherein the spring lever is also rotatably secured to the retaining clips, said handle urging the spring lever into engagement with the frame when the handle is rotated into a locked position.

10. The recessed lighting fixture recited in claim 9 wherein the spring lever includes an angled leg for obliquely engaging the frame.

11. The recessed lighting fixture recited in claim 9 wherein the spring lever includes a convex section for engaging a protrusion form the handle.

12. The recessed lighting fixture recited in claim 9 wherein an end of the handle has at least one cam-shaped lobe for exerting a force against the side of the wall when the handle is rotated into a locked position.

13. The recessed lighting fixture recited in claim 12 the retaining clip is configured to be compressed against an outside surface of the side wall when the handle is positioned against an inside surface of the side wall.

14. The recessed lighting fixture recited in claim 13 wherein the retaining clip includes compressible legs configured to be compressed against an outside surface of the side wall when the handle is positioned against an inside surface of the side wall.

15. A method of installing a recessed lighting fixture in a ceiling, the method comprising:

providing a recessed lighting fixture comprising:

a housing having a side wall, an opening, a lip extending outwardly around at least a portion of the circumference of the opening, and a slot in the side wall, a frame having an aperture sized for slidably receiving the housing, and a retaining clip slideable along the slot;

a handle, rotatably secured to the retaining clip, for locking the retaining clip in the slot;

a spring lever, extending from the retaining clip, for urging the housing into engagement with the frame when the retaining clip is locked in the slot;

positioning the frame in the ceiling;

sliding the housing into the frame; and locking the retaining clip and the spring lever in the slot.

16. The method of claim 15 wherein positioning the frame in the ceiling further comprises passing the frame through a hole in the ceiling and positioning the aperture above the hole in the ceiling.

17. The method of claim 15 further comprising adjusting the position of the lip of the housing relative to a lower surface of the ceiling to compensate for a thickness of the ceiling.

18. The method of claim 17 wherein the locking assembly is slidable within the slot and adjusting the position of the lip further comprises slidably adjusting a position of the locking assembly in the slot.

19. A recessed lighting fixture comprising:

a housing having a sidewall with an opening on a bottom end for receiving a lamp;

a slot formed in the sidewall of the housing and extending to the opening;

flared lip formed around at least a portion of the opening;

a frame having an aperture for receiving a top end of the housing;

a spring lever positionable in the slot for supporting the housing in the frame; and means for releasably urging the spring lever through the slot and into engagement with the frame, and for releasably securing the spring lever to the housing.

20. The lighting fixture recited in claim 19 wherein said urging and securing means comprises:

a retaining clip for engaging an exterior surface of the sidewall;

said retaining clip including at least one projection extending through the slot and inside the housing;

said spring lever having one end pinned to the projection;

means, pinned to the projection, for releasably locking the retaining clip in the slot and for rotating the spring lever into engagement with the frame.

21. The lighting fixture recited in claim 20, wherein said locking and rotating means comprises a handle having a cam-shaped lobe at one end that is pinned to the projection.

* * * * *